United States Patent [19]

Boissevain et al.

[11] Patent Number: 5,020,469

[45] Date of Patent: Jun. 4, 1991

[54] CROSS-DIRECTIONAL STEAM APPLICATION APPARATUS

[75] Inventors: Mathew G. Boissevain, Los Altos; Tobias J. Boissevain, Mountain View; Anthony D. Foskett, San Jose, all of Calif.

[73] Assignee: Measurex Corporation, Cupertino, Calif.

[21] Appl. No.: 303,494

[22] Filed: Jan. 27, 1989

[51] Int. Cl.[5] ..... B05C 12/00

[52] U.S. Cl. ..... 118/67; 118/68; 118/117; 118/118; 162/207; 137/883; 239/562; 239/568

[58] Field of Search ..... 118/67, 68, 101, 117, 118/118; 34/114; 239/562, 563, 564, 568; 427/366, 377, 378; 137/883; 162/207

[56] References Cited

U.S. PATENT DOCUMENTS

| | | | |
|---|---|---|---|
| 795,412 | 7/1905 | Olson | 55/434 |
| 929,270 | 7/1909 | Ashton | 55/319 |
| 1,428,670 | 9/1922 | Middleton | 55/434 |
| 2,091,805 | 8/1937 | Chuse | 162/207 |
| 2,366,484 | 1/1945 | Bradner | 92/68 |
| 3,161,482 | 12/1964 | Gshwind et al. | 34/114 |
| 3,218,227 | 11/1965 | Moore et al. | 239/566 |
| 3,853,604 | 12/1974 | Fleissner | 117/119.8 |
| 3,938,261 | 2/1976 | Anderson | 34/114 |
| 4,422,575 | 12/1983 | Dove | 239/562 |
| 4,543,737 | 10/1985 | Boissevain | 34/92 |
| 4,580,355 | 4/1986 | Boissevain | 34/54 |
| 4,765,067 | 8/1988 | Taylor | 34/23 |
| 4,642,164 | 2/1987 | Hanhikowski et al. | 162/207 |
| 4,786,529 | 11/1988 | Boissevain | 118/68 |
| 4,844,341 | 7/1989 | Alba | 239/562 |

FOREIGN PATENT DOCUMENTS

| | | |
|---|---|---|
| 0235699 | 9/1987 | European Pat. Off. . |
| 2150163 | 6/1985 | United Kingdom . |

OTHER PUBLICATIONS

Tappi Journal, Feb. 1988, "Process Control and Automation of Supercalenders", by Hannu Malkia.

*Primary Examiner*—Bernard Nozick
*Attorney, Agent, or Firm*—Spensley Horn Jubas & Lubitz

[57] ABSTRACT

An apparatus, including a manifold pipe, for applying variable amounts of steam to sections of a calenderable material to control certain properties of the material such as gloss. Built-in steam flow control valves are provided along the manifold pipe to control the amount of steam applied to each section. Bucket nozzles provided on the valves decrease the velocity of the steam jetted from the valves and eliminate any condensate present in the steam before discharging the steam against a surface of the calenderable material. Condensate which may form on the apparatus may be channeled away from the calenderable material by a pair of gutters.

10 Claims, 3 Drawing Sheets

62
72
70
64
22
58
60
66
50
52
74
68
42
54
54
44
76
76
46
34
30
48

CROSS-DIRECTIONAL STEAM APPLICATION APPARATUS

BACKGROUND OF THE INVENTION

1. Field of the Invention

The present invention relates primarily to the field of paper making machinery, and more particularly to an apparatus for applying variable amounts of steam to calenderable sheet material, thereby controlling certain properties of the material such as its cross-directional gloss profile.

2. Related Art

One of the parameters used in grading sheet materials is the gloss of the surface. In the paper production process, various grades of paper having different surface gloss are produced to suit various applications. Typically, bulk paper is produced in a continuous sheet and wound in rolls having dimensions 12 to 36 feet in the cross-direction (i.e., across the width of the sheet). Uniformity of gloss on the paper surface is often desirable or necessary. For example, in the situation where the roll of paper is cut to size for making various paper products, the consistency of the gloss of the individual paper items is dependent upon the uniformity of the gloss of the original bulk paper roll.

Paper production typically involves a calendering process which includes pressing paper material between calender rolls to obtain desired physical characteristics Calendering paper can change its density, thickness, and surface characteristics, including gloss In conjunction with calendering, steam is frequently applied to paper being calendered so as to moisten and heat the paper and thereby affect certain of its characteristics. For example, gloss is typically created on the surface of paper by applying steam to the paper surface, followed by pressing the paper between a series of calender rolls, typically arranged in a stack of alternating hard polished steel rolls and soft or resilient rolls made of cotton. The paper absorbs the steam, and paper fibers at the surface are softened by the heat and moisture. As the steam-treated paper surface comes into contact with the calender rolls, it is smoothed by the pressing and rubbing actions of the polished steel roll and adjacent cooperating soft roll. The degree of gloss created is dependent on the amount of moisture and heat and hence the amount of steam applied to the surface. Typically, very small amounts of steam are needed to create the desired gloss.

A common problem encountered in making a glossy finish using a steam treatment is the non-uniformity of the gloss finish of the calendered material. Localized variations in the amount of steam applied to the surface of the bulk paper may affect the uniformity of the gloss finish. Also, there are other variables in the calendering process such as temperature and calender roll pressure which may affect the amount of steam required for a particular degree of gloss. A more uniform gloss finish can be obtained if the amount of steam directed at different sections of the paper surface can be controlled.

Another common problem associated with the application of steam in calendering a gloss finish is that excess steam that has not been absorbed by the paper condenses on cool surfaces of the adjacent structure of the calender system. For example, the steam may condense on the steel calender roll, which will wet the paper as the steel roll contacts the paper. The extra moisture from the steel calender roll in addition to the moisture applied directly to the sheet from the steam supply will affect the moisture distribution and hence the gloss finish and other physical properties of the paper. In addition, excess steam may condense on a cool portion of the paper surface at a location where steam treatment is not intended, thereby affecting the gloss profile or causing "picking" (bulging and bubbling) when the paper becomes too wet. Moreover, steam which condenses on cool surfaces forms water droplets which may drip on the paper as it passes through the system of calender rolls, thereby again affecting the desired properties of the paper. Also, since the creation of gloss on a sheet of paper is generally the final step in paper manufacturing, the paper may already have been coated with various materials and an application of too much steam may cause problems by softening any water soluble coatings which then adhere to the calender rolls, causing "scaling".

In the past, steam boxes have been utilized to distribute steam on paper sheets during calendering. A steam box designed for applying steam to achieve uniform cross-directional gloss is disclosed in U.S. Pat. No. 4,786,529 to Boissevain. The disclosed steam box functions by discharging jets of steam through holes in the steam box. However, since more steam is discharged than can be absorbed by the paper, the excess steam must be eliminated to prevent its condensation on structures adjacent the steam treatment zone. To remove excess steam, a suction device is provided. Although highly useful in many situations, the steam box disclosed in U.S. Pat. No. 4,786,529 may not be appropriate in some situations because of its relatively complicated structure.

In an alternative design, a concentric pipe system has been utilized to distribute steam on a calenderable material to achieve certain properties such as gloss. One pipe system comprises an inner pipe having a top slot extending the length of the pipe. The inner pipe is surrounded by a second pipe having a slightly larger diameter and a bottom slot extending its length. The second pipe, in turn, is surrounded by yet a third pipe having a slightly larger diameter than the second pipe and a top slot extending its length. Steam flows first into the inner pipe, out its top slot into the second pipe, out of the bottom slot of the second pipe into the third pipe, and finally out of the top slot of the third pipe. A shortcoming of the concentric pipe system, however, is that it provides no control over the amount of steam applied to different sections of the paper surface; instead, this rather complicated structure provides a uniform amount of steam to all sections.

SUMMARY OF THE INVENTION

The present invention is directed toward an apparatus for distributing variable amounts of steam against a sheet material, such as paper, during calendering. The invention is particularly suitable for applications requiring relatively small amounts of steam, for example, to create uniform gloss on at least one side of a calenderable material. The invention provides simple, efficient and precise control of steam distribution in the cross-direction by selectively directing variable amounts of steam against sections of the material by means of built-in flow control valves spaced in the cross-direction of the calenderable material. The invention also provides means for channeling any condensate away from the calenderable sheet. Due to its simple design, the invention may be manufactured at a lower cost than the alternative steam application systems described above.

In the illustrated embodiment, the steam distribution apparatus of the present invention comprises a steam manifold positioned adjacent to a calender stack and situated adjacent the side of the material to which steam will be applied before the material being calendered is pressed between a polished calender roll and an adjacent cooperating roll. The steam manifold spans the calenderable sheet of material in the cross-direction. Spaced along the side of the steam manifold are a plurality of valves, each valve being provided with a "bucket nozzle" through which steam is discharged. Pressurized steam is delivered to the valves by the steam manifold. The amount of steam discharged through each bucket nozzle is controlled by its corresponding valve. The bucket nozzles convert the pressurized, relatively high velocity steam from the valves into low velocity "lazy" steam. Any condensate present in the steam as it flows from the valves is diverted by the associated bucket nozzles and is discharged away from the calenderable material. By controlling the volume of steam flowing through each bucket nozzle, the steam distribution on the surface of the calenderable material may be controlled, for example, to adjust the gloss profile on the surface. Gutters provided on the sides of the steam manifold divert any condensate which may form on the valves or bucket nozzles away from the calenderable material. Such steam manifolds with corresponding valves and bucket nozzles may be provided on either side of the calender stack to allow application of steam to both surfaces of the material being calendered and/or to allow application of steam in stages to the same side of the sheet as the sheet progresses through the calender stack.

When the invention is used to effect a uniform gloss on calenderable material, the gloss profile may be monitored at various points of the calendering process using a gloss gage, and steam distribution may immediately be adjusted as needed. A gloss gage functions by monitoring the gloss profile on the surface of the calenderable material at intervals in the cross-direction of the material and generating a signal corresponding to the measured gloss. The signals from the gage are fed to a valve control device of the steam distribution apparatus which may adjust the volume of steam entering the manifold (or each manifold in a system utilizing multiple steam application apparatuses) and the volume of steam entering each bucket nozzle through the valves of the manifold. The amount of steam applied to each section of the surface of the calenderable material in the cross-direction is thereby more uniformly controlled.

BRIEF DESCRIPTION OF THE DRAWINGS

Like reference characters in the various drawings refer to like elements.

DETAILED DESCRIPTION OF THE PREFERRED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims.

Figure 1:
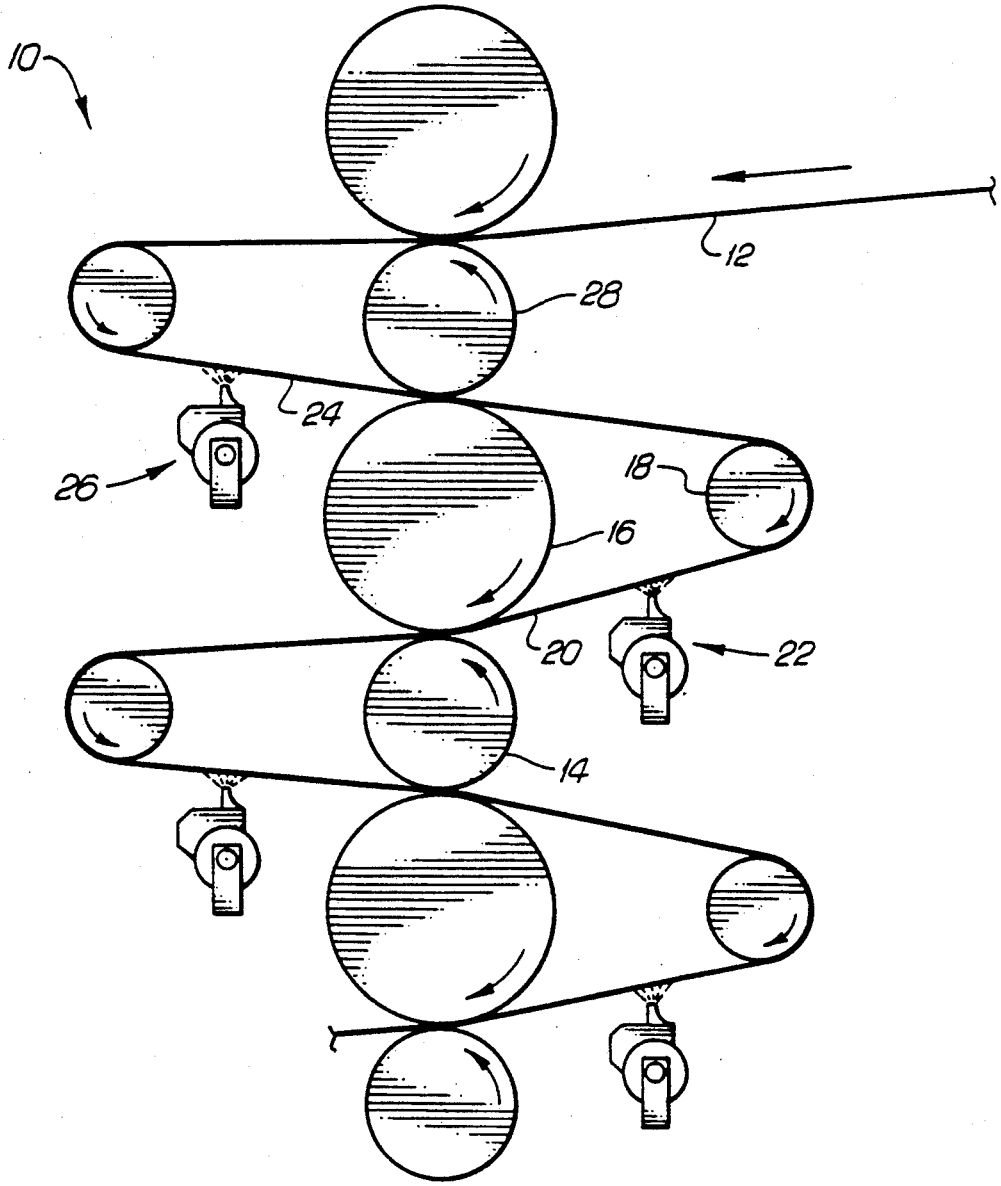
FIG. 1 shows a side plan view illustrating a system of calender rolls for production of sheet material in which the present invention may be utilized to steam treat the surface of the material.

FIG. 1 shows an example of a calendering apparatus with which the present invention may be used. FIG. 1 illustrates a system of calender rolls 10 suitable for pressing a sheet of calenderable material, such as paper 12, to obtain desired physical characteristics of the calenderable material. For convenience, the invention will be described hereafter with reference to paper as the calenderable material and gloss as the desired physical characteristic. The system of calender rolls 10 includes at least one roll 14 having a highly polished hard surface. Typically, the polished roll 14 surface is made of steel (referred to as the "steel roll" hereafter). Provided adjacent to the steel roll 14 is a roll having a somewhat resilient surface, referred to hereafter as a soft roll 16. One or more steel rolls 14 and soft rolls 16 may be arranged in a vertical stack wherein the paper passes between the rolls in a path of a general "S" configuration. Idler rolls 18 may be provided on the sides of the stack to facilitate the movement of the paper.

Gloss is created on one side of the paper sheet 12 as the paper passes between the steel roll 14 and its adjacent soft roll 16. Gloss is created only on the surface 20 of the paper sheet 12 which has been treated with steam. A steam application apparatus 22 of the present invention is positioned adjacent to this surface 20 of the sheet 12 at location upstream of the steel roll 14 (with reference to the direction of travel of the paper). The steam application apparatus 22 directs steam at the paper surface 20 as the surface approaches the steel roll 14. The steam application apparatus 22 is preferably positioned leaving an approximately three-inch gap between it and the paper surface 20. The steam emitted by the steam application apparatus 22 softens the surface of the paper by action of the heat and moisture associated with the steam before the paper is pressed by the steel roll 14 against the backing of the soft roll 16. A gloss finish is formed on the surface 20 of the paper 12 which has been treated with steam. To form a gloss finish on the other side 24 of the paper 12, another steam application apparatus 26 working in conjunction with a second steel roll 28 and soft roll 16 may be employed in the same manner.

Figure 2:
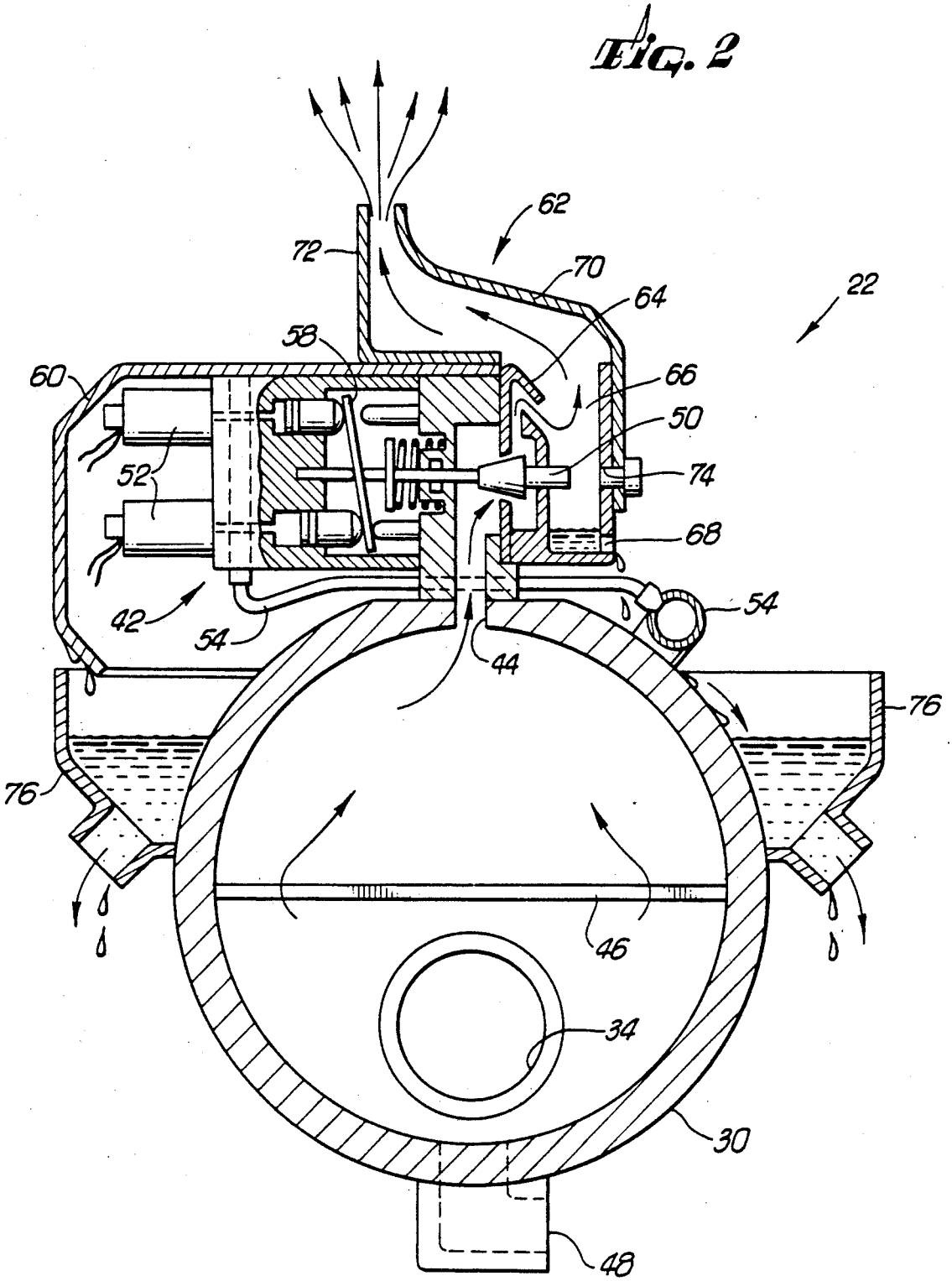
FIG. 2 shows a cross-sectional view of an embodiment of the present invention illustrating a particular internal structure of the steam manifold, and a valve and bucket nozzle.

The structure of the steam application apparatus of the present invention is described with reference to FIGS. 2 and 3. FIG. 2 is a cross-sectional view of an embodiment of the present steam application apparatus 22. In the illustrated embodiment, the steam application apparatus 22 comprises a steam manifold fabricated from a pipe 30 having a length generally spanning the width of the sheet of paper to which steam will be applied (i.e. in the cross-direction). Different paper manufacturers manufacture sheets of paper of differing widths, ranging generally from 12 to 36 feet. Accordingly, the length of the manifold pipe 30 will vary. The manifold pipe 30 is preferably made from corrosion-resistant material such as, for example, stainless steel or aluminum. It has been determined that a six-inch inside diameter stainless steel pipe having a 3/16" wall offers adequate structural support to the steam application apparatus. Such a pipe is readily available at relatively low cost, and thus offers a major benefit over more complex and costly steam application systems.

Figure 3:
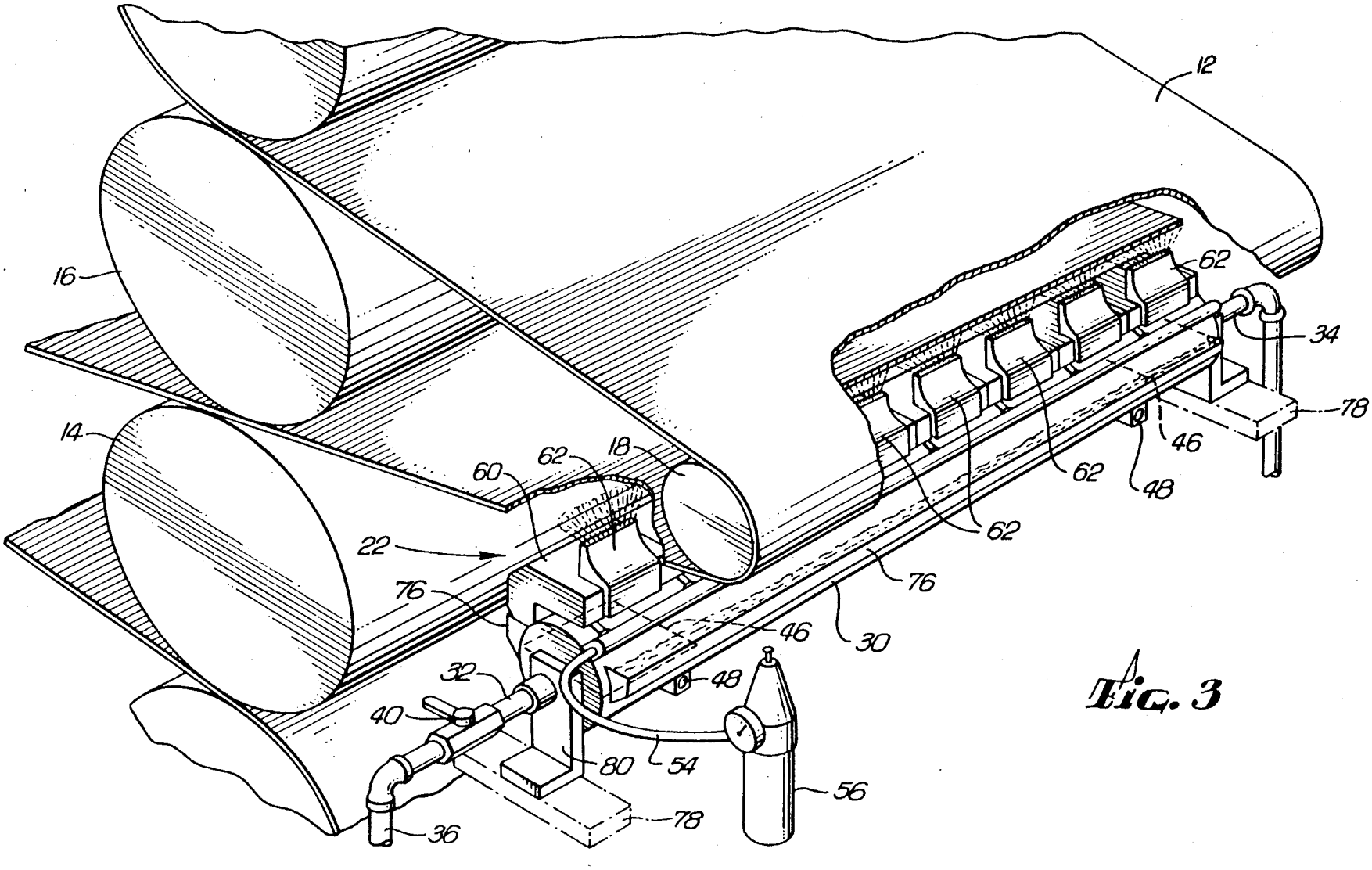
FIG. 3 shows a perspective view of a calender roll system and the inventive steam application apparatus with a portion of the idler roll and material being calendered cut-away so as to better show the inventive apparatus.

As is shown in FIG. 3, the steam manifold pipe 30 is provided with an inlet pipe 32 at one end and an outlet pipe 34 at its opposite end. Suitable inlet and outlet pipes 32 and 34 have a diameter which is smaller than the diameter of the steam manifold pipe 30 (for example, two inches) Steam, preferably in a saturated state at 1-15 psig pressure, is delivered into the inlet pipe 32 by a main supply pipe 36. The inlet pipe 32 is provided with a pressure control valve 40 and a pressure sensor (not shown). Steam will enter the steam manifold pipe 30 only if the pressure control valve 40 is at least partially open. Therefore, in applications where a plurality of steam application apparatuses are provided, as shown in FIG. 1, each individual steam manifold pipe 30 may be supplied with steam independently of the other steam pipes. Furthermore, the individual steam pressure valves 40 allow control over the volume of steam entering each steam manifold pipe 30. Thus, the amount of steam applied by each steam manifold pipe 30 can be regulated, thereby increasing the control over the gloss distribution. Also, gloss may be created in increments by the multiple pipes.

A computerized valve control device may be employed to activate the pressure control valves 40. It is desirable, however, to also provide a mechanism for manual control of the valve 40. In a system utilizing a computerized valve control device, a gloss gauge may be provided at a location downstream of the steam application apparatus to monitor the gloss on the paper surface 20. The gloss gauge provides a signal to the control device (not shown) corresponding to the degree of gloss of the paper surface. Depending on the deviation in the measured gloss of the paper surface 20 from the desired gloss profile, the valve control device selectively transmits feedback control signals to the pressure control valve 40 to adjust its output. In applications using multiple steam application apparatuses, the various pressure control valves of the steam application apparatuses located upstream of the gloss gauge may be adjusted so as to allow more or less steam to enter the steam manifold pipes 30, thereby dynamically adjusting the amount of gloss obtained at the end of the calendering process.

As is shown in FIG. 2, a plurality of steam valves 42 are mounted to the top of the steam manifold pipe 30. In the illustrated embodiment, each steam valve 42 is mounted into an orifice having the shape of a slot 44 provided in the top of the manifold pipe 30. Pressurized steam enters the valves 42 from the pipe 30 through the slots 44. In the illustrated embodiment, each slot 44 is approximately 1.5 to 2 inches long and has a width of approximately ½ inch to allow an adequate volume of steam to enter the valves 42. The slots 44 are preferably distributed in even intervals along the entire length of the steam manifold pipe 30. Accordingly, the number of slots 44 with mounted valves 42 provided on a particular steam manifold pipe 30 depends upon the length of the pipe 30. Resolution of the control over the cross-directional gloss profile is increased as the distance between the slots 44 and associated valves 42 is decreased. To achieve optimum control over the cross-directional gloss profile, the distance between slots 44 is preferably only a few inches (typically about three inches).

A baffle 46 is mounted inside the steam manifold pipe 30 adjacent the steam inlet pipe 32 and between the inlet pipe 32 and the valves 42. The baffle 46 prevents condensate potentially present in the steam from entering the valves 42 located near the steam inlet pipe 32. The baffle 46 spans the diameter of the steam pipe 30 and is preferable approximately ten inches long. A second baffle may be provided inside the steam manifold pipe 30 adjacent its outlet pipe 34 and between the outlet pipe 34 and the valves 42 to allow for reverse installation (i.e., steam flowing into the pipe 30 through the outlet pipe 34). Condensate present in steam entering the steam manifold pipe 30 is deflected by the baffle 46 and collects at the bottom of the pipe, where it is drained out of the pipe 30 through at least one condensate drain orifice 48 provided in the steam manifold pipe 30 (see FIG. 3).

Each valve 42 of the illustrated embodiment of the present invention, as shown in FIG. 2, may be a 16-position digital steam valve as disclosed in more detail in the commonly assigned, simultaneously filed co-pending United States Patent Application of Mathew G. Boissevain, entitled, Digitally Incremented Linear Actuator. Serial No. 07/303,450 (attorney docket no PD-9443)*. In general, the 16-position digital steam valve disclosed comprises a poppet valve 50 actuated by four solenoid valves 52 (two of which are not shown) such as the HS-LS Series Solenoid Valves commercially available from Numatics, Inc. (Mich.). Air flows to the solenoid valves 52 from air hose 54. The air hose 54, mounted adjacent the steam valves 42, channels air from an air regulator 56 to the air inlet of each solenoid valve 52 at a pressure of approximately 40 psig for activation of the associated pistons 53 associated with the solenoid valves 52. Once a solenoid valve 52 is activated, air is admitted behind the associated piston 53 which is forced against a lever 58, and which in turn contacts the poppet valve 50. The number of solenoid valves 52 activated determines the position of the lever 58 and thereby the position of the poppet valve 50. The position of the poppet valve 50, in turn, determines the volume of steam flowing through the nozzle 62 to eventually reach the paper.

This patent application is incorporated herein by reference.

In the presently illustrated embodiment, the dimensions of the poppet valve 50 and bucket nozzle 62 are such that, when the poppet valve 50 is fully open, the nozzle 62 will expel approximately 15-25 lbs/hour of steam per foot of sheet in the cross-direction. Moreover, this "lazy" steam exiting the nozzle 62 in this particular illustrated embodiment has little or no velocity by the time it reaches the sheet. Thus, because of the limited velocity and volume of steam exiting the nozzle 62, the apparatus of the illustrated embodiment avoids the necessity of a vacuum device for removing excess steam. In fact, when such low steam volume and velocity are used, the steam may be condensed to liquid by the time it contacts the sheet 12.

A computerized valve control device used to activate the pressure control valve 40 may also be used to activate the solenoid valves 52. To maintain a uniform gloss or give a predetermined gloss profile on the paper surface, adjustments of the valves 42 may be dynamically made to adjust the amount of steam flowing from each of the poppet valves 50 mounted along the length of the pipe.

Although the illustrated embodiment of the invention utilizes a 16-position digital valve 42, many types of commonly available valves may be utilized instead of the illustrated value.

In the illustrated embodiment, each valve 42 is provided with a cover 60 to protect the valve components from exposure to condensate which may form on the steam application apparatus.

To convert the high velocity steam jetted from each valve 42 into low velocity, "lazy" steam, each valve 42 is provided with a bucket nozzle 62. In the illustrated embodiment of the invention, bucket nozzle 62 is mounted to the cover 60. The bucket nozzle 62 comprises a cane-shaped deflector plate 64 mounted adjacent the poppet valve, a container 66 (preferably having the shape of a bucket), provided with at least one drain hole 68 in its bottom, and a nozzle portion. For convenience, the bucket 66 of the bucket nozzle 62 is provided with a small orifice 74 to allow access to the poppet valve 50 for manual screwdriver adjustments. Pressurized steam entering the bucket nozzle 62 through the poppet valve 50 jets up against the deflector plate 64, which redirects the steam's flow to the bottom of the bucket 66. Condensate present in the steam collects at the bottom of the bucket 66 and then drains out the drain holes 68. The steam, on the other hand, rises to the top of the bucket 66 and against a second, curved deflector 70 which, in conjunction with a third, off-set deflector 72, forms the nozzle portion of the bucket nozzle 62. The deflectors 64, 70 and 72 cooperate to remove substantially all liquid from and decrease the velocity of the steam. The "lazy" steam is thus directed against the paper by the bucket nozzle 62 at a relatively low velocity.

Condensate formed on the components of the steam application apparatus or drained from the bucket 66 of the bucket nozzle 62 is directed away from the paper being calendered by a pair of gutters 76 provided on the steam manifold pipe 30. The gutters 76 are mounted, one on each side, along the entire length of the steam manifold pipe 30. The gutters 76, as well as the bucket nozzle 62 and baffle 46, are preferably made of corrosion-resistent material such as, for example, stainless steel or aluminum.

As shown in FIG. 3, the steam application apparatus of the present invention may be mounted directly to a mounting base 78 provided on the calender stack using a yoke 80. The steam application apparatus may be incorporated into any calender stack since it functions equally well if mounted at a variety of angles relative to the sheet about the axis of the manifold pipe 30. Thus the invention provides great flexibility as well as a high degree of control over steam distribution at a low cost.

In summary, the present invention provides an apparatus for controlling physical characteristics of a calenderable material by selectively directing varying amounts of steam against sections of the surface of the calenderable material in the cross-direction. Built-in valves control the steam distribution in the cross-direction. The invention also provides simple means of removing condensate from the steam, before it is directed against the calenderable material, and from the steam apparatus itself, thereby preventing liquid from coming into contact with the calenderable material. When used to effect gloss on paper, a gloss gauge may be used to detect the degree of glossiness of the surface of the paper and a feedback valve control device may be used to activate the valves in accordance with the detected gloss.

One preferred embodiment of the present invention has been described Nevertheless, it will be understood that various modifications may be made without departing from the spirit and scope of the invention. For example, the steam manifold pipe may be curved or indented along its side to fit closely against the curved surface of a calender roll. Also, the configuration of the slots may be modified to be of different sizes than shown, and to be spaced at different intervals. Although the present invention is described with reference to the gloss of paper, the invention includes controlling, by steam treatment, physical characteristics other than gloss on different types of materials. Furthermore, a working fluid other than steam may be employed without departing from the principles of the present invention. Accordingly, it is to be understood that the invention is not to be limited by the specific illustrated embodiments, but only by the scope of the appended claims and equivalents thereof.

I claim:

1. An apparatus for distributing a controlled amount of working fluid on a surface of a calenderable sheet of material, comprising:

(a) a manifold pipe, the manifold pipe comprising an inlet, an outlet, and a plurality of orifices formed at intervals along the length of the manifold pipe; and (b) a plurality of controllable discharge means for controllably discharging working fluid, each discharge means in flow communication with one of the plurality of orifices of the manifold pipe, wherein each discharge means includes a bucket nozzle comprising a container, a plurality of deflectors and at least one drain.

2. An apparatus as in claim 1, wherein the discharge means further comprises means for eliminating working fluid not in a gaseous phase before the working fluid exits the bucket nozzle.

3. An apparatus as in claim 1, wherein each discharge means includes control means for individually varying the amount of working fluid discharged by the discharge means.

4. An apparatus as in claim 3, wherein each control means comprises a flow control valve in flow communication with a corresponding orifice.

5. An apparatus as in claim 1, wherein the manifold pipe further comprises means for eliminating working fluid not in a gaseous phase from the working fluid introduced from the manifold pipe inlet.

6. An apparatus as in claim 5, wherein the means for eliminating working fluid not in a gaseous phase comprises at least a first baffle disposed inside the manifold pipe adjacent the inlet, whereby working fluid entering the inlet must pass around the baffle before reaching any of the plurality of orifices.

7. The apparatus of claim 1, wherein the bucket nozzle includes:

(a) a first deflector of the plurality of defectors disposed so as to deflect the working fluid as it vents from a valve, whereby the deflection by the first deflector decreases the velocity of the working fluid;

(b) the container for collecting the deflected working fluid and removing liquid therefrom, the container having a plurality of sides and a bottom having at least a first drain orifice through which the liquid is discharged; and (c) means for discharging the working fluid at a further reduced velocity.

8. The apparatus of claim 7, wherein the means for discharging the working fluid at a further reduced velocity comprises at least a second and a third deflector, the second deflector being disposed at an angle above the sides of the container and the third deflector being disposed above and offset from the sides of the container.

9. An apparatus for distributing a controlled amount of working fluid on a surface of a calenderable sheet of material, comprising:

(a) a manifold pipe, the manifold pipe comprising an inlet, an outlet, and a plurality of orifices formed at intervals along the length of the manifold pipe; and (b) a plurality of controllable discharge means for controllably discharging working fluid, each discharge means in flow communication with one of the plurality of orifices of the manifold pipe, wherein each discharge means includes a bucket nozzle for eliminating working fluid not in a gaseous phase, comprising a container, at least one drain and a plurality of deflectors.

10. An apparatus for distributing a controlled amount of working fluid on a surface of a calenderable sheet of material, comprising:

(a) a manifold pipe, the manifold pipe comprising an inlet, an outlet, and a plurality of orifices formed at intervals along the length of the manifold pipe;

(b) a plurality of controllable discharge means for controllably discharging working fluid, each discharge means in flow communication with one of the plurality of orifices of the manifold pipe; and wherein the manifold pipe includes a pair of gutters for channeling liquid away from the calenderable sheet of material, the gutters being mounted on either side of the discharge means.

* * * * *